US011794505B2

(12) United States Patent
Fukuri et al.

(10) Patent No.: US 11,794,505 B2
(45) Date of Patent: Oct. 24, 2023

(54) RESIN-DISPERSED LIQUID FOR DYE-RECEPTOR LAYER

(71) Applicant: KAO CORPORATION, Tokyo (JP)

(72) Inventors: Norihiro Fukuri, Wakayama (JP); Hiroto Soma, Wakayama (JP); Christopher Johnson, Jamestown, NC (US)

(73) Assignee: KAO CORPORATION, Tokyo (JP)

( * ) Notice: Subject to any disclaimer, the term of this patent is extended or adjusted under 35 U.S.C. 154(b) by 474 days.

(21) Appl. No.: 16/636,515

(22) PCT Filed: Nov. 21, 2018

(86) PCT No.: PCT/US2018/062214
§ 371 (c)(1),
(2) Date: Feb. 4, 2020

(87) PCT Pub. No.: WO2019/104143
PCT Pub. Date: May 31, 2019

(65) Prior Publication Data

US 2020/0254805 A1 Aug. 13, 2020

Related U.S. Application Data

(60) Provisional application No. 62/590,730, filed on Nov. 27, 2017.

(51) Int. Cl.
*B41M 5/52* (2006.01)

(52) U.S. Cl.
CPC ..... *B41M 5/5272* (2013.01); *B41M 5/5227* (2013.01); *B41M 2205/02* (2013.01); *B41M 2205/32* (2013.01)

(58) Field of Classification Search
CPC .. B41M 5/5227; B41M 5/5272; B41M 5/529; B41M 2205/02; B41M 2205/32
See application file for complete search history.

(56) References Cited

U.S. PATENT DOCUMENTS

| | | | |
|---|---|---|---|
| 5,001,106 | A | 3/1991 | Egashira et al. |
| 5,290,750 | A | 3/1994 | Kushi et al. |
| 6,818,370 | B2 | 11/2004 | Uchinokura et al. |
| 2008/0220191 | A1 | 9/2008 | Kawamura |
| 2009/0056862 | A1 | 3/2009 | Kamiyoshi et al. |
| 2010/0028569 | A1 | 2/2010 | Kamiyoshi et al. |
| 2010/0139013 | A1 | 6/2010 | Ban et al. |
| 2012/0264862 | A1 | 10/2012 | Matsumoto et al. |
| 2012/0269992 | A1 | 10/2012 | Kamiyoshi et al. |

FOREIGN PATENT DOCUMENTS

| | | | |
|---|---|---|---|
| CN | 106592329 | A | 4/2017 |
| JP | 5-77563 | A | 3/1993 |
| JP | 10-226156 | A | 8/1998 |
| JP | 2002-19306 | A | 1/2002 |
| JP | 2009-73172 | A | 4/2009 |
| JP | 2010-6976 | A | 1/2010 |
| JP | 2010-36409 | A | 2/2010 |
| JP | 2011-136433 | A | 7/2011 |
| JP | 2011-255521 | A | 12/2011 |
| JP | 2013-970 | A | 1/2013 |
| JP | 2013-1081 | A | 1/2013 |
| JP | 2014-37060 | A | 2/2014 |
| JP | 2014-37061 | A | 2/2014 |
| JP | 2014-139264 | A | 7/2014 |
| JP | 2014-218061 | A | 11/2014 |
| JP | 2015-116771 | A | 6/2015 |
| WO | WO 2006/109875 | A1 | 10/2006 |

OTHER PUBLICATIONS

Machine Translation of JP 2011-255521 (Year: 2011).*
International Search Report and Written Opinion dated Jan. 31, 2019 in PCT/US2018/062214 filed on Nov. 21, 2018.

* cited by examiner

*Primary Examiner* — Sathavaram I Reddy
(74) *Attorney, Agent, or Firm* — Oblon, McClelland, Maier & Neustadt, L.L.P.

(57) ABSTRACT

A resin dispersion for dye receiving layer of a thermal transfer image-receiving sheet, including a polyester resin particle and an aqueous medium. The polyester resin particle includes a polyester resin that is a polycondensate of an alcohol component including at least one of a propylene oxide adduct of 2,2-bis(4-hydroxyphenyl)propane and an ethylene oxide adduct of 2,2-bis(4-hydroxyphenyl)propane, and a carboxylic acid component including an aliphatic dicarboxylic acid compound having a carbon number of 6 or more and 10 or less. A molar ratio of the propylene oxide adduct of 2,2-bis(4-hydroxyphenyl)propane to the ethylene oxide adduct of 2,2-bis(4-hydroxyphenyl)propane in the alcohol component is 0/100 or more and 40/60 or less. A molar ratio of the ethylene oxide adduct of 2,2-bis(4-hydroxyphenyl)propane to the aliphatic dicarboxylic acid compound having a carbon number of 6 or more and 10 or less is 2.1 or more and 15 or less.

17 Claims, No Drawings

RESIN-DISPERSED LIQUID FOR DYE-RECEPTOR LAYER

FIELD OF THE INVENTION

The present disclosure relates to a resin dispersion for dye receiving layer of a thermal transfer image-receiving sheet which is used for forming a receiving layer of a thermal transfer image-receiving sheet for printing by a thermal transfer recording apparatus, a thermal transfer image-receiving sheet, a printing method, and a method for producing a thermal transfer image-receiving sheet.

BACKGROUND OF THE INVENTION

A thermal transfer recording apparatus, such as a sublimation-type thermal transfer printer, is widely known as a printer to be used for photo printing. In the thermal transfer recording apparatus, a sublimable dye coated on a heat-sensitive transfer recording medium, such as an ink ribbon, is transferred onto a thermal transfer image-receiving sheet by a heated printing head and printed. In the thermal transfer image-receiving sheet to be used for printing by the thermal transfer recording apparatus, a receiving layer for a dye is formed on its surface.

PTL 1 (JP 2010-006976 A) discloses a production method of a polyester dispersion including (1) a step of dissolving a polyester having a Log P value of 3.0 to 5.0 in an organic solvent to obtain a solution of the polyester; (2) a step of adding a neutralizing agent to the solution of the polyester obtained in the step (1) so as to satisfy a formula: $10 \leq A \times B \leq 18$ (wherein A represents a neutralization equivalent of the polyester in the polyester solution, and B represents an acid value (mgKOH/g) of the polyester), thereby neutralizing the polyester; and (3) a step of adding water to the solution of the polyester neutralized in the step (2) to emulsify the polyester. It is disclosed that according to the said production method, a polyester dispersion having a small particle diameter and a sharp particle size distribution and capable of providing a thermal transfer image-receiving sheet with excellent releasability may be stably produced.

PTL 2 (JP 2009-073172 A) discloses a resin dispersion for dye receiving layer containing a resin dispersion of a polyester dispersed in an aqueous medium and a releasing agent, wherein the polyester is obtained by using an alcohol component (a) containing 80 mol % or more of an alkylene oxide adduct of 2,2-bis(4-hydroxyphenyl)propane represented by the formula (1), and (b) having a content ratio of an ethylene oxide adduct and a propylene oxide adduct (ethylene oxide adduct/propylene oxide adduct) in the alkylene oxide adduct of the alkylene oxide adduct of the 2,2-bis(4-hydroxyphenyl)propane of 50/50 to 0/100 in terms of a molar ratio. It is disclosed that according to the said resin dispersion, a thermal transfer image-receiving sheet that is excellent in dyeability of a dye upon thermal transfer, excellent in releasability from a transfer sheet, and excellent in transfer image performance can be formed.

PTL 3 (JP 2014-139264 A) discloses a polyester resin having an acid value of 300 to 2,500 eq/$10^6$ g and a number average molecular weight of 2,000 to 50,000, wherein the acid value derived from a polycarboxylic acid not incorporated in a resin skeleton is 30% to 80% in the above acid value. It is disclosed that according to the said polyester resin, an aqueous dispersion resin composition having a self-emulsification function capable of forming an aqueous emulsion without using an emulsifier or an organic solvent and having high water dispersibility and storage stability is obtained.

PTL 1: JP 2010-006976 A
PTL 2: JP 2009-073172 A
PTL 3: JP 2014-139264 A

SUMMARY OF THE INVENTION

Embodiments according to the present invention are concerned with the following [1] to [5].

[1] A resin dispersion for dye receiving layer of a thermal transfer image-receiving sheet, containing a polyester resin particle and an aqueous medium, wherein the polyester resin particle contains a polyester resin that is a polycondensate of an alcohol component containing at least one selected from the group consisting of a propylene oxide adduct of 2,2-bis(4-hydroxyphenyl)propane and an ethylene oxide adduct of 2,2-bis(4-hydroxyphenyl)propane and a carboxylic acid component containing an aliphatic dicarboxylic acid compound having a carbon number of 6 or more and 10 or less, a molar ratio of the propylene oxide adduct of 2,2-bis(4-hydroxyphenyl)propane to the ethylene oxide adduct of 2,2-bis(4-hydroxyphenyl)propane in the alcohol component is 0/100 or more and 40/60 or less, and a molar ratio of the ethylene oxide adduct of 2,2-bis(4-hydroxyphenyl)propane to the aliphatic dicarboxylic acid compound having a carbon number of 6 or more and 10 or less is 2.1 or more and 15 or less.

[2] A coating liquid for forming a receiving layer of a thermal transfer image-receiving sheet, containing the resin dispersion of [1].

[3] A thermal transfer image-receiving sheet including a substrate and a receiving layer formed with the coating liquid of [2].

[4] A printing method including: bringing a heat-sensitive transfer recording medium containing a dye into contact with the thermal transfer image-receiving sheet of [3]; and thermally-transferring the dye onto the thermal transfer image-receiving sheet.

[5] A method for producing a thermal transfer image-receiving sheet, including:

forming a receiving layer on a substrate by using a coating liquid containing a resin dispersion containing a polyester resin particle and an aqueous medium, wherein the polyester resin particle contains a polyester resin that is a polycondensate of an alcohol component containing at least one selected from the group consisting of a propylene oxide adduct of 2,2-bis(4-hydroxyphenyl)propane and an ethylene oxide adduct of 2,2-bis(4-hydroxyphenyl)propane and a carboxylic acid component containing an aliphatic dicarboxylic acid compound having a carbon number of 6 or more and 10 or less, a molar ratio of the propylene oxide adduct of 2,2-bis(4-hydroxyphenyl)propane to the ethylene oxide adduct of 2,2-bis(4-hydroxyphenyl)propane in the alcohol component is 0/100 or more and 40/60 or less, and a molar ratio of the ethylene oxide adduct of 2,2-bis(4-hydroxyphenyl)propane to the aliphatic dicarboxylic acid compound having a carbon number of 6 or more and 10 or less is 2.1 or more and 15 or less.

DETAILED DESCRIPTION OF THE INVENTION

According to the resin dispersion disclosed in PTL 2, the releasability is improved when it contains a large amount of the propylene oxide adduct of 2,2-bis(4-hydroxyphenyl) propane. However, it is mentioned that in the case where a large amount of the ethylene oxide adduct of 2,2-bis(4-hydroxyphenyl)propane is contained, the releasability from the heat-sensitive transfer recording medium upon printing is worsened.

Furthermore, the thermal transfer image-receiving sheet to be used for printing by a thermal transfer recording apparatus is required to have dyeability such that its surface is colored with a dye. However, there was involved such a problem that when the dyeability is enhanced, the storage stability of the dispersion is lowered.

One embodiment of the present invention is concerned with a resin dispersion, a thermal transfer image-receiving sheet, a printing method, and a method for producing a thermal transfer image-receiving sheet, those are excellent in dyeability, releasability, and storage stability.

In one embodiment of the present invention, by combining the ethylene oxide adduct of 2,2-bis(4-hydroxyphenyl) propane as the alcohol component of the polyester resin with the aliphatic dicarboxylic acid compound as the carboxylic acid component, the excellent film strength was obtained, the releasability between the heat-sensitive transfer recording medium and the receiving layer was improved, and the long-term stability in the dispersion was improved.

Namely, the embodiment of the present invention is concerned with a resin dispersion of a thermal transfer image-receiving sheet containing a polyester resin particle (hereinafter also referred to as "polyester resin particle X") and an aqueous medium (such a resin dispersion will be hereinafter also referred to simply as "resin dispersion").

The polyester resin particle X contains a polyester resin that is a polycondensate of an alcohol component containing at least one selected from the group consisting of a propylene oxide adduct of 2,2-bis(4-hydroxyphenyl)propane (hereinafter also referred to simply as "BPA-PO") and an ethylene oxide adduct of 2,2-bis(4-hydroxyphenyl)propane (hereinafter also referred to simply as "BPA-EO") and a carboxylic acid component containing an aliphatic dicarboxylic acid compound having a carbon number of 6 or more and 10 or less (such a polyester resin will be hereinafter also referred to as "polyester resin A").

A molar ratio of BPA-PO to BPA-EO in the alcohol component of the polyester resin A is 0/100 or more and 40/60 or less. In the case where the molar ratio of BPA-PO to BPA-EO falls within the prescribed range, the polyester resin exhibits appropriate glass transition temperature and hydrophilicity, and it is possible to make dyeability, releasability, and storage stability compatible with each other.

In the polyester resin A, a molar ratio of BPA-EO to the aliphatic dicarboxylic acid compound having a carbon number of 6 or more and 10 or less is 2.1 or more and 15 or less. In the case where the molar ratio of BPA-EO to the predetermined aliphatic dicarboxylic acid compound falls within the prescribed range, the polyester resin A exhibits appropriate glass transition temperature and hydrophilicity, and it is possible to make dyeability, releasability, and storage stability compatible with each other.

According to the said constitution, a resin dispersion that is excellent in dyeability, releasability, and storage stability is obtained. By using the said resin dispersion, it is possible to provide a thermal transfer image-receiving sheet that is excellent in dyeability and releasability, a printing method, and a method for producing a thermal transfer image-receiving sheet.

In the embodiment of the present invention, by combining the ethylene oxide adduct of 2,2-bis(4-hydroxyphenyl)propane with a specified aliphatic dicarboxylic acid compound as the carboxylic acid component, as compared with the resin disclosed in PTL 1 or PTL 2, the glass transition temperature can be made low, and therefore, it may be considered that the dye becomes easy to be dispersed in the resin, whereby the dyeability is improved.

On the other hand, only when the glass transition temperature is made simply low, a trade-off is caused in which the film strength and the releasability between the heat-sensitive transfer recording medium and the receiving layer are lowered. As compared with the resin disclosed in PTL 3, in the resin according to the embodiment of the present invention, by combining the ethylene oxide adduct of 2,2-bis(4-hydroxyphenyl)propane with a specified aliphatic dicarboxylic acid compound as the carboxylic acid component, the hydrophilicity of the resin is improved, and therefore, a releasing agent that is hydrophobic becomes easy to be localized on the surface of the image-receiving layer, and as a result, it may be considered that it has become possible to secure the releasability even when the glass transition temperature is low. Furthermore, it may be conjectured that a part of micro crystals can be formed in the resin through a combination of the monomers of the resin according to the embodiment of the present invention, and the micro crystals have a filler effect, whereby such also gives an influence as a factor to secure the film strength.

With respect to the storage stability of the resin dispersion, when the glass transition temperature of the resin becomes low, the resin becomes easy to be plasticized, whereby the storage stability of the resin dispersion is generally lowered. However, in the embodiment of the present invention, even when the glass transition temperature is low, it may be considered that it has become possible to secure the storage stability even in the dispersion by improving the hydrophilicity of the resin.

Definitions, etc. of various terminologies in this specification are shown below.

Whether the resin is crystalline or amorphous is judged by a crystallinity index. The crystallinity index is defined by a ratio of a softening point of the resin and a highest endothermic peak temperature (softening point (° C.)/highest endothermic peak temperature (° C.)) in the measurement method described in the section of Examples as mentioned later. The crystalline resin means a resin having a crystallinity index of 0.6 or more and less than 1.4, preferably 0.7 or more, and more preferably 0.9 or more, and preferably 1.2 or less. The amorphous resin is a resin having a crystallinity index of 1.4 or more or less than 0.6, preferably 1.5 or more or 0.5 or less, and more preferably 1.6 or more or 0.5 or less. The crystallinity index can be properly regulated by kinds of the raw material monomers and a ratio thereof and a production condition, such as reaction temperature, reaction time, and cooling rate. The highest endothermic peak temperature refers to a temperature of a peak present on the highest temperature side among observed endothermic peaks. The crystallinity index can be calculated from a value obtained by the measurement method of a softening point of the resin and a highest endothermic peak temperature as described in the section of Examples.

The "carboxylic acid compound" is a concept including not only that carboxylic acid but also an anhydride which is decomposed during the reaction to form an acid and an alkyl ester of a carboxylic acid (for example, one in which the alkyl moiety thereof has a carbon number of 1 or more and 3 or less).

In the case where the carboxylic acid compound is an alkyl ester of a carboxylic acid, the carbon number of the alkyl group that is an alcohol residue of the ester is not counted in the carbon number of the carboxylic acid compound.

[Resin Dispersion]

From the viewpoint of obtaining excellent dyeability, releasability, and storage stability, the resin dispersion for dye receiving layer according to the embodiment of the present invention contains the polyester resin particle X and an aqueous medium.

[Aqueous Medium]

The aqueous medium is preferably one containing water as a main component.

The content of water in the aqueous medium is preferably 80% by mass or more, more preferably 90% by mass or more, still more preferably 95% by mass or more, and yet still more preferably 98% by mass or more, and it is 100% by mass or less, and more preferably 100% by mass. The water is preferably deionized water or distilled water.

Examples of other component than water, which may be contained in the aqueous medium, include organic solvents capable of being dissolved in water, such as alkyl alcohols having a carbon number of 1 or more and 5 or less; dialkyl ketones having a carbon number of 3 or more and 5 or less, e.g., acetone and methyl ethyl ketone; and cyclic ethers, e.g., tetrahydrofuran.

[Polyester Resin Particle X]

From the viewpoint of obtaining excellent dyeability, releasability, and storage stability, the polyester resin particle X contains the polyester resin A.

The polyester resin particle X may further contain other polyester resin, a releasing agent, and so on.

The content of the polyester resin A is preferably 80% by mass or more, more preferably 90% by mass or more, still more preferably 95% by mass or more, and yet still more preferably 98% by mass or more, and it is 100% by mass or less, and preferably 100% by mass, in the polyester resin particle X.

<Polyester Resin A>

From the viewpoint of obtaining excellent dyeability, releasability, and storage stability, the polyester resin A is a polycondensate of an alcohol component containing at least one selected from the group consisting of BPA-PO and BPA-EO and a carboxylic acid component containing an aliphatic dicarboxylic acid compound having a carbon number of 6 or more and 10 or less.

BPA-PO is, for example, a compound represented by the following formula (I):

(I)

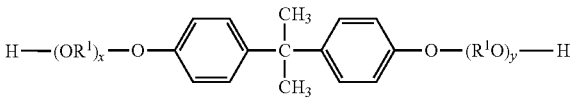

wherein $OR^1$ and $R^1O$ are each a propyleneoxy group; and x and y are each an average addition molar number of propylene oxide and a positive number, and a value of the sum of x and y is 1 or more, and preferably 1.5 or more, and it is 16 or less, preferably 8 or less, more preferably 4 or less, and still more preferably 3 or less.

BPA-EO is, for example, a compound represented by the following formula (II):

(II)

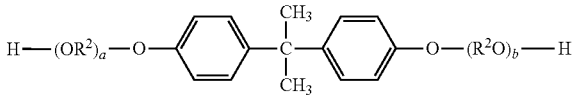

wherein $OR^2$ and $R^2O$ are each an ethyleneoxy group; and a and b are each an average addition molar number of ethylene oxide and a positive number, and a value of the sum of a and b is 1 or more, and preferably 1.5 or more, and it is 16 or less, preferably 8 or less, more preferably 4 or less, and still more preferably 3 or less.

From the viewpoint of obtaining excellent dyeability and storage stability, in particular, more excellent storage stability, a molar ratio of BPA-PO to BPA-EO in the alcohol component is 0/100 or more and 40/60 or less, preferably 30/70 or less, more preferably 20/80 or less, still more preferably 10/90 or less. The molar ratio of BPA-PO to BPA-EO may be 1/99 or more, and it may be preferably 1.5/98.5 or more, and more preferably 2/98 or more.

A total content of BPA-PO and BPA-EO is preferably 70 mol % or more, more preferably 90 mol % or more, and still more preferably 95 mol % or more in the alcohol component, and it is 100 mol % or less, and preferably 100 mol %. The total content of BPA-PO and BPA-EO may also be 99 mol % or less, preferably 98 mol % or less, and more preferably 97 mol % or less.

The alcohol component may further contain other alcohol component.

Examples of the other alcohol component include aliphatic polyols. Examples of the aliphatic polyol include aliphatic diols having a carbon number of 2 or more and 20 or less and trihydric or higher hydric aliphatic alcohols, such as glycerin.

Examples of the aliphatic diol include ethylene glycol, 1,2-propanediol, 1,3-propanediol, 1,4-butanediol, 1,5-pentanediol, 1,6-hexanediol, 1,4-butenediol, 1,3-butanediol, neopentyl glycol, 1,10-decanediol, and 1,12-dodecanediol.

The content of the aliphatic diol, especially glycerin may be preferably 3 mol % or less, more preferably 2 mol % or less, and still more preferably 1 mol % or less in the alcohol component.

The aliphatic dicarboxylic acid compound having a carbon number of 6 or more and 10 or less to be contained as the carboxylic acid component is preferably a saturated aliphatic dicarboxylic acid compound, and more preferably a saturated linear aliphatic dicarboxylic acid compound.

Examples of the aliphatic dicarboxylic acid compound having a carbon number of 6 or more and 10 or less include adipic acid, suberic acid, and sebacic acid. These may be used alone or in combination of two or more thereof. Of these, adipic acid or sebacic acid is preferred, and adipic acid is more preferred from the viewpoint of more improving dyeability, releasability, and storage stability.

From the viewpoint of more improving dyeability and releasability, the content of the aliphatic dicarboxylic acid compound having a carbon number of 6 or more and 10 or less is preferably 5 mol % or more, more preferably 7 mol % or more, still more preferably 10 mol % or more, yet still more preferably 15 mol % or more, even yet still more preferably 20 mol % or more, even still more preferably 25 mol % or more, and even still more further preferably 30 mol % or more in the carboxylic acid component, and from the viewpoint of more improving storage stability, it is preferably 60 mol % or less, more preferably 50 mol % or less, still more preferably 47 mol % or less, and yet still more preferably 40 mol % or less.

From the viewpoint of obtaining excellent dyeability, releasability, and storage stability, in particular, more excellent releasably and storage stability, a molar ratio of BPA-EO to the aliphatic dicarboxylic acid compound having a carbon number of 6 or more and 10 or less is 15 or less, preferably 12 or less, more preferably 10 or less, still more preferably 7 or less, and yet still more preferably 5 or less, and it is 2.1 or more, preferably 2.4 or more, and more preferably 2.7 or more.

From the viewpoint of more improving dyeability, releasability, and storage stability, the carboxylic acid component preferably contains an aromatic dicarboxylic acid compound.

Examples of the aromatic dicarboxylic acid compound include phthalic acid, isophthalic acid, and terephthalic acid. These may be used alone or in combination of two or more thereof. Of these, terephthalic acid or isophthalic acid is preferred, and terephthalic acid is more preferred from the viewpoint of more improving dyeability, releasability and storage stability.

From the viewpoint of more improving storage stability, the content of the aromatic dicarboxylic acid compound is preferably 10 mol % or more, more preferably 20 mol % or more, still more preferably 30 mol % or more, and yet still more preferably 40 mol % or more in the carboxylic acid component, and from the viewpoint of more improving dyeability and releasability, it is preferably 95 mol % or less, more preferably 90 mol % or less, still more preferably 80 mol % or less, yet still more preferably 75 mol % or less, and even yet still more preferably 70 mol % or less.

From the viewpoint of more improving dyeability, releasability, and storage stability, the carboxylic acid component preferably contains a trivalent or higher valent carboxylic acid compound.

Examples of the trivalent or higher valent carboxylic acid compound include 1,2,4-benzenetricarboxylic acid (trimellitic acid), 2,5,7-naphthalenetricarboxylic acid, pyromellitic acid, and anhydrides thereof. Of these, trimellitic acid or an acid anhydride thereof is preferred.

From the viewpoint of more improving dyeability and storage stability, the content of the trivalent or higher valent carboxylic acid is preferably 5 mol % or more, more preferably 8 mol % or more, and still more preferably 10 mol % or more in the carboxylic acid component, and from the viewpoint of more improving releasability, it is preferably 50 mol % or less, more preferably 40 mol % or less, still more preferably 30 mol % or less, and yet still more preferably 20 mol % or less.

The carboxylic acid component may further contain other carboxylic acid compound.

Examples of the other carboxylic acid compound include aliphatic dicarboxylic acid compounds having a carbon number 5 or less and aliphatic dicarboxylic acid compounds having a carbon number 11 or more.

Examples of the aliphatic dicarboxylic acid compound having a carbon number of 5 or less include oxalic acid, malonic acid, maleic acid, fumaric acid, citraconic acid, itaconic acid, glutaconic acid, and succinic acid.

Examples of the aliphatic dicarboxylic acid compound having a carbon number of 11 or more include aliphatic dicarboxylic acids, such as dodecanedioic acid and succinic acids substituted with an alkyl group having a carbon number of 1 or more and 20 or less or an alkenyl group having a carbon number of 2 or more and 20 or less, e.g., dodecenylsuccinic acid and octylsuccinic acid. These may be used alone or in combination of two or more thereof.

An equivalent ratio of a carboxy group of the carboxylic acid component to a hydroxy group of the alcohol component (COOH group/OH group) is preferably 0.7 or more, and more preferably 0.8 or more, and it is preferably 1.3 or less, and more preferably 1.2 or less from the viewpoint of regulating the terminal group.

The polycondensation of the alcohol component and the carboxylic acid component may be, for example, performed in an inert gas atmosphere in the optional presence of an esterification catalyst (hereinafter also referred to simply as "catalyst"), a polymerization inhibitor, and the like at a temperature of about 180° C. or higher and 250° C. or lower. Examples of the catalyst include tin compounds, such as dibutyltin oxide and tin(II) 2-ethylhexanoate, and titanium compounds, such as titanium diisopropylate bistriethanolaminate. Examples of an esterification co-catalyst (hereinafter also referred to simply as "co-catalyst") which may be used together with the catalyst include gallic acid. The use amount of the catalyst is preferably 0.01 parts by mass or more, and more preferably 0.1 parts by mass or more, and it is preferably 1 part by mass or less, and more preferably 0.6 parts by mass or less, based on 100 parts by mass of the total amount of the alcohol component and the carboxylic acid component. The use amount of the co-catalyst is preferably 0.001 parts by mass or more, and more preferably 0.01 parts by mass or more, and it is preferably 0.5 parts by mass or less, and more preferably 0.1 parts by mass or less, based on 100 parts by mass of the total amount of the alcohol component and the carboxylic acid component.

<Properties of Polyester Resin A>

From the viewpoint of more improving releasability and storage stability, a softening point of the polyester resin A is preferably 80° C. or higher, more preferably 85° C. or higher, and still more preferably 90° C. or higher, and from the viewpoint of more improving dyeability, it is preferably 120° C. or lower, more preferably 110° C. or lower, and still more preferably 105° C. or lower.

From the viewpoint of more improving releasability and storage stability, a glass transition temperature of the polyester resin A is preferably 30° C. or higher, more preferably 40° C. or higher, and still more preferably 45° C. or higher, and from the viewpoint of more improving dyeability, it is preferably lower than 60° C., more preferably 55° C. or lower, and still more preferably 50° C. or lower.

From the viewpoint of more improving storage stability, an acid value of the polyester resin A is preferably 30 mgKOH/g or less, more preferably 25 mgKOH/g or less, and still more preferably 20 mgKOH/g or less, and it is preferably 4 mgKOH/g or more, more preferably 8 mgKOH/g or more, and still more preferably 10 mgKOH/g or more.

From the viewpoint of more improving dyeability, a number average molecular weight of the polyester resin A is preferably 6,000 or less, more preferably 5,500 or less, and still more preferably 5,000 or less, and from the viewpoint of more improving releasability and storage stability, it is preferably 1,000 or more, more preferably 2,000 or more, still more preferably 3,000 or more, yet still more preferably 4,000 or more, and even yet still more preferably 4,300 or more.

From the viewpoint of obtaining excellent dyeability, a weight average molecular weight of the polyester resin A is preferably 65,000 or less, more preferably 60,000 or less, still more preferably 55,000 or less, and yet still more preferably 50,000 or less, and from the viewpoint of more improving releasability and storage stability, it is preferably 1,000 or more, more preferably 5,000 or more, still more preferably 10,000 or more, yet still more preferably 20,000 or more, even yet still more preferably 30,000 or more, and even still more preferably 40,000 or more.

The measurement methods of the softening point, the glass transition temperature, the acid value, the number average molecular weight, and the weight average molecular weight are those described in the section of Examples. In the case of containing two or more resins, with respect to the softening point, the glass transition temperature, the acid value, the number average molecular weight, and the weight average molecular weight, it is preferred that their weighted average values fall within the aforementioned ranges, respectively.

From the viewpoint of more improving dyeability, releasability, and storage stability, a volume median particle diameter ($D_{50}$) of the polyester resin particle X in the resin dispersion is preferably 1 μm or less, more preferably 800 nm or less, still more preferably 400 nm or less, and yet still more preferably 200 nm or less, and it is preferably 50 nm or more, and more preferably 80 nm or more.

The volume median particle diameter ($D_{50}$) is determined by the method described in the section of Examples as mentioned later.

From the viewpoint of more improving dyeability and releasability, the content of the polyester resin particle X is preferably 20% by mass or more, and more preferably 25% by mass or more relative to the resin dispersion, and from the viewpoint of more improving storage stability, it is preferably 50% by mass or less, more preferably 40% by mass or less, and still more preferably 35% by mass or less.

Besides, additives, such as a defoaming agent and an antibacterial agent, may be added.

Examples of the defoaming agent include a defoaming agent emulsion "TEGO Foamex 825" (available from Evonik).

The content of the defoaming agent in the resin dispersion is preferably 0.003 parts by mass or more, more preferably 0.007 parts by mass or more, and still more preferably 0.01 parts by mass or more, and it is preferably 1 part by mass or less, more preferably 0.5 parts by mass or less, and still more preferably 0.1 parts by mass or less, based on 100 parts by mass of the polyester resin.

Examples of the antibacterial agent include a halogenated benzalkonium salt.

From the viewpoint of improving dyeability and storage stability of the dispersion, the halogenated benzalkonium salt is preferably a compound represented by the following formula (1):

(1)

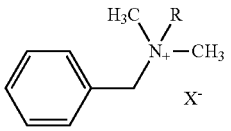

wherein R is an alkyl group having a carbon number of 8 or more and 18 or less; and X is a halogen atom.

The carbon number of the alkyl group for R is preferably 8 or more and 14 or less, and more preferably 8.

The halogen for X is preferably a chlorine atom, a bromine atom, or an iodine atom, and more preferably a chlorine atom.

Though the reason why the dyeability can be improved is not always elucidated, it may be considered that aggregation of the particle in the dispersion is suppressed by means of the addition of the halogenated benzalkonium salt, and as a result, the dye is appropriately diffused.

Examples of a marketed product of the antibacterial agent include "Proxel GXL", "PROXEL XL2", "PROXEL LV", and "PROXEL CRL2" (all of which are available from Lonza Inc.).

From the viewpoint of improving storage stability and dyeability of the dispersion, the content of the antibacterial agent in the resin dispersion is preferably 0.1 parts by mass or more, more preferably 0.3 parts by mass or more, and still more preferably 0.6 parts by mass or more, and it is preferably 10 parts by mass or less, more preferably 5 parts by mass or less, and still more preferably 3 parts by mass or less, based on 100 parts by mass of the polyester resin.

From the viewpoint of more improving dyeability and releasability, a solid concentration of the resin dispersion is preferably 20% by mass or more, and more preferably 25% by mass or more, and from the viewpoint of more improving storage stability, it is preferably 50% by mass or less, more preferably 40% by mass or less, and still more preferably 35% by mass or less.

The solid concentration is determined by the method described in the section of Examples as mentioned later.

From of the viewpoint of more improving dyeability and releasability, a pH of the resin dispersion is preferably 4 or more, more preferably 5 or more, and still more preferably 6 or more, and from the viewpoint of more improving storage stability, it is preferably 9 or less, and more preferably 8 or less.

The aforementioned resin dispersion can be used for a dye receiving layer of a thermal transfer image-receiving sheet.

[Coating Liquid for Forming Receiving Layer of Thermal Transfer Image-Receiving Sheet]

The aforementioned resin dispersion can be used as a coating liquid for forming a receiving layer of a thermal transfer image-receiving sheet (hereinafter also referred to simply as "coating liquid").

The coating liquid contains, for example, the aforementioned resin dispersion.

The coating liquid preferably further contains a releasing agent.

The coating liquid may further contain a film-forming agent.

[Releasing Agent]

The resin dispersion is used for forming a receiving layer of a thermal transfer image-receiving sheet for printing by a thermal transfer recording apparatus, and therefore, it preferably further contains a releasing agent.

Examples of the releasing agent include a polyether-modified silicone, dimethylsiloxane, an alcohol-modified silicone, polyethylene, polypropylene, and inorganic fine particles, such as colloidal silica.

Examples of the polyether-modified silicone include a polyether-modified silicone having a polydialkylsiloxane main chain and a polyether chain.

The polyether-modified silicone may have a polyether chain grafted on the polydialkylsiloxane main chain or may have a polyether chain in both terminals of the polydialkylsiloxane main chain. Of these, a polyether-modified silicone having a polyether chain grafted on the polydialkylsiloxane main chain is preferred.

Examples of the polyether chain include a polyethylene oxide chain, a polypropylene oxide chain, and a polyethylene oxide/propylene oxide chain. Of these, a polyethylene oxide/propylene oxide chain is preferred.

Above all, a polyether-modified silicone having a polyether chain grafted on a polydialkylsiloxane main chain is preferred, and a polyether-modified silicone having a polyethylene oxide/propylene oxide chain grafted on a polydialkylsiloxane main chain is more preferred.

Examples of a marketed product of the polyether-modified silicone include "KF-6012", "KF-615A", "KF-6011", and "X-22-4515" (all of which are available from Shin-Etsu Chemical Co., Ltd.); "SF-8410", "L-7002", and "FZ2164" (all of which are available from Dow Corning Toray Co., Ltd.); and "Silwet L-7210", "Silwet L-7230", "Silwet L-7600", and "Silwet L-7605" (all of which are available from Momentive Performance Materials Inc.).

A degree of penetration•diffusion of the releasing agent in the resin dispersion is affected by an HLB of the releasing agent or a viscosity of the releasing agent.

From the viewpoint of improving releasability, the HLB of the releasing agent is preferably 3 or more, more preferably 4 or more, still more preferably 5 or more, and yet still more preferably 6 or more, and it is preferably 14 or less, more preferably 12 or less, still more preferably 11 or less, yet still more preferably 10 or less, even yet still more preferably 9.5 or less, even still more preferably 9 or less, even still more further preferably 8 or less, and even yet still more further preferably 7 or less.

The HLB value is a value to be calculated from a haze number A measured by the following method according to the following formula (A) (see "Surfactant Handbook", page 324, Ichiro Nishi, et al., published by Sangyo Tosho Co., Ltd., 1960).

$$HLB=0.89\times A+1.11 \quad (A)$$

In the formula, A is a haze number measured by the following method.

(Measurement Method of Haze Number A)

0.5 g of a sample (releasing agent) is dissolved in 5 mL of ethanol and titrated with a 2% by mass phenol aqueous solution with stirring while being kept at 25° C., and a time when the liquid assumes cloudiness is defined as an end point. A titer (mL) of the 2% by mass phenol aqueous solution needed for this titration is defined as the haze number A.

From the viewpoint of improving releasability, a kinematic viscosity of the releasing agent is preferably 500 $mm^2/s$ or more, more preferably 800 $mm^2/s$ or more, still more preferably 1,100 $mm^2/s$ or more, yet still more preferably 1,300 $mm^2/s$ or more, even yet still more preferably 1,500 $mm^2/s$ or more, and even still more preferably 1,700 $mm^2/s$ or more, and it is preferably 8,000 $mm^2/s$ or less, more preferably 6,000 $mm^2/s$ or less, and still more preferably 4,500 $mm^2/s$ or less.

The kinematic viscosity is a value measured at 25° C. using a Ubbelohde viscometer in conformity with JIS Z8803:2011.

The content of the releasing agent in the resin dispersion is preferably 1 part by mass or more, more preferably 3 parts by mass or more, and still more preferably 4 parts by mass or more, and it is preferably 15 parts by mass or less, more preferably 10 parts by mass or less, and still more preferably 8 parts by mass or less, based on 100 parts by mass of the polyester resin.

[Film-Forming Agent]

The resin dispersion is used for forming a receiving layer of a thermal transfer image-receiving sheet for printing by a thermal transfer recording apparatus, and therefore, it preferably further contains a film-forming agent.

Examples of the film-forming agent include butyl carbitol acetate, diethyl carbitol, and gelatin. Of these, butyl carbitol acetate is preferred.

The content of the film-forming agent in the resin dispersion is preferably 0.1 parts by mass or more, more preferably 1 part by mass or more, still more preferably 3 parts by mass or more, and yet still more preferably 5 parts by mass or more, and it is preferably 20 parts by mass or less, more preferably 15 parts by mass or less, and still more preferably 13 parts by mass or less, based on 100 parts by mass of the polyester resin.

[Production Method of Thermal Transfer Image-Receiving Sheet]

A method for producing a thermal transfer image-receiving sheet according to the embodiment of the present invention includes, for example:

dispersing the polyester resin A in an aqueous medium to prepare a resin dispersion (hereinafter also referred to as "step 1"); and forming a receiving layer on a substrate by using a coating liquid containing the resin dispersion (hereinafter also referred to as "step 2").

[Step 1]

The resin dispersion is obtained by dispersing the polyester resin A in an aqueous medium.

Though dispersion may be performed by adopting a known method, it is preferred to perform the dispersion by a phase inversion emulsification method. Examples of the phase inversion emulsification method include a method of undergoing the phase inversion emulsification by adding an aqueous medium in an organic solvent solution of the polyester resin A or the molten polyester resin A.

Though the organic solvent which is used for the phase inversion emulsification is not particularly limited so long as it is able to dissolve the polyester resin A therein, examples thereof include methyl ethyl ketone.

It is preferred to add a neutralizing agent, such as a basic substance, to the organic solvent solution. Examples of the basic substance include alkali metal hydroxides, such as sodium hydroxide and potassium hydroxide; and nitrogen-containing basic substances, such as ammonia, trimethylamine, triethylamine, and diethanolamine. Of these, triethylamine is preferred.

A use equivalent (mol %) of the neutralizing agent relative to the acid radical of the polyester resin A is preferably 10 mol % or more, more preferably 30 mol % or more, and still more preferably 50 mol % or more, and it is preferably 150 mol % or less, more preferably 120 mol % or less, and still more preferably 100 mol % or less.

The use equivalent (mol %) of the neutralizing agent can be determined according to the following formula. The use equivalent of the neutralizing agent is synonymous with a degree of neutralization in the case where it is 100 mol % or less.

Use equivalent of neutralizing agent (mol %)=[{Addition mass of neutralizing agent (g)/Equivalent of neutralizing agent}/[{Acid value of polyester resin *A* (mgKOH/g)×Mass of polyester resin *A* (g)}/(56×1,000)]]×100

The aqueous medium is gradually added to the organic solvent solution or the molten resin with stirring, thereby undergoing the phase inversion emulsification.

After the phase inversion emulsification, the organic solvent may be removed from the resulting dispersion by means of distillation or the like, as the need arises.

To the resulting resin dispersion, an additive, such as a film-forming agent, a releasing agent, an antibacterial agent, and a defoaming agent, may be added.

[Step 2]

<Substrate>

Examples of the substrate which is used in the step 2 include papers and resin sheets.

Examples of the paper include synthetic papers (such as polyolefin-based papers and polystyrene-based papers), wood-free papers, art papers, coated papers, cast coated papers, wall papers, backing papers, synthetic resin- or emulsion-impregnated papers, synthetic rubber latex-impregnated papers, synthetic resin-internally added papers, paper boards, and cellulose fiber papers.

Examples of the resin which is used for the resin sheet include polyolefins, polyvinyl chloride, polyethylene terephthalate, polystyrene, polymethacrylates, and polycarbonates. The resin sheet may also be, for example, a white opaque film resulting from film formation upon addition of a white pigment or a filler, or a foamed resin sheet resulting from expansion.

A thickness of the substrate may be, for example, 10 μm or more and 2 mm or less, or 10 μm or more and 300 μm or less.

From the viewpoint of improving an adhesion to the receiving layer or a heat insulating layer, it is preferred to subject the surface of the substrate to a primer treatment or a corona discharge treatment.

From the viewpoint of cushioning properties and heat insulation properties, the substrate may have a heat insulating layer on the surface thereof. The heat insulating layer preferably contains a water-soluble polymer, such as gelatin, polyvinyl alcohol, and polyvinyl pyrrolidone, and hollow particles.

The hollow particles are preferably polymer particles having vacancies. Examples of the polymer include a styrene-acrylic copolymer and a vinylidene chloride-acrylonitrile copolymer.

Examples of a marketed product of the hollow particle include "Nipol MH8101" (available from Zeon Corporation), "HP-1055" (available from Rohm and Haas Japan K.K.), and "SX8782(D)" (available from JSR Corporation).

A mass ratio of the hollow particle to the water-soluble polymer [hollow particle/water-soluble polymer] is preferably 30/70 or more, more preferably 40/60 or more, and still more preferably 50/50 or more, and it is preferably 90/10 or less, more preferably 80/20 or less, and still more preferably 75/25 or less.

A thickness of the heat insulating layer is, for example, 10 μm or more and 100 μm or less.

The receiving layer can be formed by coating the resin dispersion onto the substrate by a gravure printing method, a screen printing method, a reverse roll coating method using a gravure printing plate, or the like.

A solid amount per 1 $m^2$ of the receiving layer after drying is preferably 1 $g/m^2$ or more, and more preferably 2 $g/m^2$ or more, and it is preferably 10 $g/m^2$ or less, and more preferably 5 $g/m^2$ or less. The coating is preferably executed so as to adapt to the said solid amount after drying.

The formed coated film may be dried at 40° C. or higher and 110° C. or lower.

The temperature at which the coated film is dried is preferably 40° C. or higher, more preferably 50° C. or higher, and still more preferably 55° C. or higher, and it is preferably 110° C. or lower, more preferably 100° C. or lower, and still more preferably 80° C. or lower.

[Thermal Transfer Image-Receiving Sheet]

The thermal transfer image-receiving sheet according to the embodiment of the present invention includes the substrate and the receiving layer formed with the resin dispersion.

The thermal transfer image-receiving sheet is used for printing by a thermal transfer recording apparatus, such as a sublimation-type thermal transfer printer, and has excellent dyeability and releasability. More specifically, the thermal transfer image-receiving sheet is printed by the following method.

[Printing Method]

A printing method according to the present embodiment includes:

bringing a heat-sensitive transfer recording medium containing a dye into contact with the thermal transfer image-receiving sheet; and thermally-transferring the dye onto the thermal transfer image-receiving sheet.

Examples of the heat-sensitive transfer recording medium containing a dye include an ink ribbon.

The heat-sensitive transfer recording medium includes, for example, a substrate, such as a paper and a polyester film, a dye layer containing a sublimable dye, and a protective layer for transferring on an image obtained by image-receiving of the dye, in this order.

The dye is preferably a sublimable dye. Examples of the sublimable dye include yellow dyes, such as pyridone azo-based dyes, dicyano styryl-based dyes, quinophthalone-based dyes, and merocyanine-based dyes; magenta dyes, such as benzene azo-based dyes, pyrazolone azomethine-based dyes, isothiazole-based dyes, and pyrazolo-triazole-based dyes; and cyan dyes, such as anthraquinone-based dyes, cyanomethylene-based dyes, indophenol-based dyes, and indonaphthol-based dyes.

The protective layer is formed for the purpose of preventing color fading of the image after the dye has been transferred, or attachment of moisture or a stain, such as a fingerprint, to the image from occurring.

For the thermal transfer, a known method is adopted, and for example, the thermal transfer is performed by heating the heat-sensitive transfer recording medium, which has been brought into contact with the thermal transfer image-receiving sheet, with a thermal head.

As the thermal transfer recording apparatus which is used for printing according to the present embodiment, known apparatuses can be used. Examples of a marketed product thereof include sublimation-type thermal transfer printers "MEGAPIXEL III" (available from ALTECH ADS) and "DS40" (available from DNP Fotolusio Co., Ltd.).

EXAMPLES

The present invention is hereunder specifically described by reference to Examples, but it should be construed that the present invention is by no means limited by these Examples. Properties of resins and so on were measured by the following methods.

[Measurement]

[Acid Value of Resin]

The measurement is performed on a basis of the method of JIS K0070:1992. However, with respect to only the solvent for measurement, a mixed solvent of ethanol and ether, which is prescribed in JIS K0070:1992, is changed to a mixed solvent of acetone and toluene (acetone/toluene=1/1 (volume ratio)).

[Softening Point, Highest Endothermic Peak Temperature, and Glass Transition Temperature of Resin]

(1) Softening Point

With a flow tester "CFT-500D" (available from Shimadzu Corporation), 1 g of a sample is extruded through a nozzle having a diameter of 1 mm and a length of 1 mm while heating at a temperature rise rate of 6° C./min and applying a load of 1.96 MPa thereto by a plunger. The softening point is determined as the temperature at which a half the amount of the sample is allowed to flow out when plotting a downward movement of the plunger of the flow tester relative to the temperature.

(2) Highest Endothermic Peak Temperature

With a differential scanning calorimeter "DSC 2 STAR" (available from Mettler-Toledo), a sample having been cooled from room temperature (20° C.) to 0° C. at a temperature drop rate of 10° C./min is held for one minute as it is, and then subjected to measurement while raising the temperature to 180° C. at a temperature rise rate of 10° C./min. A temperature of a peak present on the highest temperature side among observed endothermic peaks is defined as the highest endothermic peak temperature.

(3) Glass Transition Temperature

With a differential scanning calorimeter "DSC 2 STAR" (available from Mettler-Toledo), 0.01 to 0.02 g of a sample is measured in an aluminum pan, heated to 200° C., and then cooled to 0° C. from that temperature at a temperature drop rate of 10° C./min. Subsequently, the sample is heated at a temperature rise rate of 10° C./min to measure endothermic peaks. The temperature at which an extension of a baseline not higher than the highest endothermic peak temperature is intersected with a tangential line having a maximum inclination in a region of from a rise-up portion of the peak to an apex of the peak is defined as the glass transition temperature.

[Number Average Molecular Weight and Weight Average Molecular Weight of Resin]

A molecular weight distribution is measured by the gel permeation chromatography (GPC) method according to the following method, thereby determining the number average molecular weight and the weight average molecular weight.

(1) Preparation of Sample Solution

A sample is dissolved in tetrahydrofuran at 25° C. such that a concentration thereof is 0.5 g/100 mL. Subsequently, the resultant solution is then filtered through a fluororesin filter "Syringe Filter" (available from American Chromatography Supplies LLC) having a pore size of 0.45 μm to remove insoluble components, thereby preparing a sample solution.

(2) Measurement of Molecular Weight

With the analyzer and column described below, tetrahydrofuran as an eluting solution is allowed to flow at a flow rate of 1 mL/min, and the column is stabilized in a thermostat at 40° C. 100 μL of a sample solution is injected thereinto to perform the measurement. The molecular weight of the sample is calculated on a basis of a previously prepared calibration curve. As the calibration curve at this time, one prepared by using several kinds of monodisperse polystyrenes ("A-500" ($5.0\times10^2$), "A-1000" ($1.01\times10^3$), "A-2500" ($2.63\times10^3$), "A-5000" ($5.97\times10^3$), "F-1" ($1.02\times10^4$), "F-2" ($1.81\times10^4$), "F-4" ($3.97\times10^4$), "F-10" ($9.64\times10^4$), "F-20" ($1.90\times10^5$), "F-40" ($4.27\times10^5$), "F-80" ($7.06\times10^5$), and "F-128" ($1.09\times10^6$) (all of which are available from Tosoh Corporation) as standard samples is used.

Analyzer: "HLC-8320 GPC EcoSEC" (available from Tosoh Corporation)

Column: "TSKgel Guard Super HZ-L"+"TSKgel Super HZM-H"+"TSKgel Super HZ3000" (all of which are available from TOSOH Bioscience)

[Solid Concentration of Resin Dispersion]

Using an analyzer "Halogen Moisture Analyzer HR73" (available from METTLER TOLEDO), 5 g of a measurement sample is measured for the water content (% by mass) at a drying temperature of 150° C. (monitoring time: 2.5 minutes, variation width: 0.05%). The solid concentration is calculated according to the following formula.

Solid concentration (% by mass)=100−(Water content (% by mass))

[pH of Resin Dispersion]

Using a pH meter "HM-20p" (available from DKK-TOA Corporation), the measurement is performed at a temperature of an aqueous dispersion of 25° C.

[Volume Median Particle Diameter ($D_{50}$) and Volume Average Particle Diameter ($D_V$) of Polyester Resin Particle X, etc. in Resin Dispersion]

(1) Analyzer: Laser diffraction-type particle diameter analyzer "Nanotrack Ultra" (available from Microtrack)

(2) Measurement condition: A cell for the measurement is filled with distilled water, and a volume median particle diameter ($D_{50}$) and a volume average particle diameter ($D_V$) are measured at a concentration at which an absorbance thereof fall within an appropriate range.

[Production of Resins]

Production Examples A1 to A9 and A51 to A55
[Resins A-1 to A-9 and A-51 to A-55]

A 10 L-volume four-necked flask equipped with a nitrogen inlet tube, a dehydration tube, a stirrer, and a thermocouple was charged with raw materials (except for an aliphatic dicarboxylic acid and trimellitic anhydride), a catalyst and a co-catalyst as shown in Table 1. The contents were subjected to a polycondensation reaction in a nitrogen atmosphere at 235° C. for 6 hours. After confirming that a degree of conversion reached 80% or more, the reaction was performed at 235° C. and 8.0 kPa for 1 hour. Thereafter, the aliphatic dicarboxylic acid and trimellitic anhydride were added thereto and allowed to react at 210° C., and the reaction was performed at 10 kPa until the resulting resin had a softening point shown in the table, thereby obtaining amorphous polyester resins A-1 to A-9 and A-51 to A-55. In the Production Examples, the degree of conversion refers to a value of {(amount of generated water in reaction)/(theoretical amount of generated water)×100}.

TABLE 1

| | | | Production Example | | | | | | | | | |
|---|---|---|---|---|---|---|---|---|---|---|---|---|
| | | | A1 | | A2 | | A3 | | A4 | | A5 | |
| | | | Amorphous resin | | | | | | | | | |
| | | | A-1 | | A-2 | | A-3 | | A-4 | | A-5 | |
| | | | Charged amount (g) | Molar ratio *3 | Charged amount (g) | Molar ratio *3 | Charged amount (g) | Molar ratio *3 | Charged amount (g) | Molar ratio *3 | Charged amount (g) | Molar ratio *3 |
| Polyester resin monomers | Alcohol component | BPA-PO *1 | — | — | — | — | — | — | 2800 | 40 | — | — |
| | | BPA-EO *2 | 6500 | 100 | 6500 | 100 | 6500 | 100 | 3900 | 60 | 6500 | 100 |
| | Acid component | Terephthalic acid | 1494 | 45 | 2324 | 70 | 1494 | 45 | 1992 | 60 | 1494 | 45 |

TABLE 1-continued

| | | | | | | | | | | | |
|---|---|---|---|---|---|---|---|---|---|---|---|
| | | Adipic acid | 1022 | 35 | 292 | 10 | — | — | 584 | 20 | 1022 | 35 |
| | | Sebacic acid | — | — | — | — | 1414 | 35 | — | — | — | — |
| | | Succinic acid | — | — | — | — | — | — | — | — | — | — |
| | | Trimellitic anhydride | 461 | 12 | 461 | 12 | 461 | 12 | 461 | 12 | 461 | 12 |
| | | | Charged amount (g) | Parts by mass *4 | Charged amount (g) | Parts by mass *4 | Charged amount (g) | Parts by mass *4 | Charged amount (g) | Parts by mass *4 | Charged amount (g) | Parts by mass *4 |
| Catalyst | Tin(II) 2-ethylhexanoate | | 18.5 | 0.2 | 19.0 | 0.2 | 19.7 | 0.2 | 19.4 | 0.2 | 18.5 | 0.2 |
| Co-catalyst | Gallic acid monohydrate | | 1.9 | 0.02 | 1.9 | 0.02 | 2 | 0.02 | 1.9 | 0.02 | 1.9 | 0.02 |
| BPA-PO/BPA-EO molar ratio | | | 0/100 | | 0/100 | | 0/100 | | 40/60 | | 0/100 | |
| BPA-EO/aliphatic dicarboxylic acid molar ratio | | | 2.86 | | 10.00 | | 2.86 | | 3.00 | | 2.86 | |
| Properties | Softening point (° C.) | | 101.5 | | 101.2 | | 97.6 | | 98.4 | | 83.2 | |
| | Highest endothermic peak temperature (° C.) | | 50.1 | | 55.7 | | 46.1 | | 53.1 | | 43.2 | |
| | Crystallinity index | | 2.03 | | 1.82 | | 2.12 | | 1.85 | | 1.93 | |
| | Glass transition temperature (° C.) | | 47.8 | | 52.8 | | 42.8 | | 51.3 | | 40.1 | |
| | Number average molecular weight Mn | | 4,500 | | 4,000 | | 4,800 | | 3,600 | | 3,200 | |
| | Weight average molecular weight Mw | | 43,000 | | 37,000 | | 45,000 | | 35,000 | | 33,000 | |
| | Acid value (mgKOH/g) | | 16.2 | | 18.2 | | 17.1 | | 18.4 | | 21.5 | |

| | | | Production Example | | | | | | | |
|---|---|---|---|---|---|---|---|---|---|---|
| | | | A6 | | A7 | | A8 | | A9 | |
| | | | Amorphous resin | | | | | | | |
| | | | A-6 | | A-7 | | A-8 | | A-9 | |
| | | | Charged amount (g) | Molar ratio *3 | Charged amount (g) | Molar ratio *3 | Charged amount (g) | Molar ratio *3 | Charged amount (g) | Molar ratio *3 |
| Polyester resin monomers | Alcohol component | BPA-PO *1 | — | — | 1400 | 20 | — | — | 140 | 2 |
| | | BPA-EO *2 | 6500 | 100 | 5200 | 80 | 6500 | 100 | 6370 | 98 |
| | Acid component | Terephthalic acid | 1494 | 45 | 1660 | 50 | 1162 | 35 | 1494 | 45 |
| | | Adipic acid | 1022 | 35 | 876 | 30 | 1314 | 45 | 1022 | 35 |
| | | Sebacic acid | — | — | — | — | — | — | — | — |
| | | Succinic acid | — | — | — | — | — | — | — | — |
| | | Trimellitic anhydride | 461 | 12 | 461 | 12 | 461 | 12 | 461 | 12 |
| | | | Charged amount (g) | Parts by mass *4 | Charged amount (g) | Parts by mass *4 | Charged amount (g) | Parts by mass *4 | Charged amount (g) | Parts by mass *4 |
| Catalyst | Tin(II) 2-ethylhexanoate | | 18.5 | 0.2 | 19.8 | 0.2 | 18.9 | 0.2 | 18.5 | 0.2 |
| Co-catalyst | Gallic acid monohydrate | | 1.9 | 0.02 | 2 | 0.02 | 1.9 | 0.02 | 1.9 | 0.02 |
| BPA-PO/BPA-EO molar ratio | | | 0/100 | | 20/80 | | 0/100 | | 2/98 | |
| BPA-EO/aliphatic dicarboxylic acid molar ratio | | | 2.86 | | 2.67 | | 2.22 | | 2.80 | |
| Properties | Softening point (° C.) | | 116.5 | | 99.4 | | 99.4 | | 102.5 | |
| | Highest endothermic peak temperature (° C.) | | 53.6 | | 52.4 | | 48.3 | | 50.9 | |
| | Crystallinity index | | 2.17 | | 1.90 | | 2.06 | | 2.01 | |
| | Glass transition temperature (° C.) | | 51.4 | | 53.2 | | 45.8 | | 49.0 | |

TABLE 1-continued

| | | | | | | | | | | | | |
|---|---|---|---|---|---|---|---|---|---|---|---|---|
| | Number average molecular weight Mn | | | 5,200 | | 3,500 | | 4,800 | | 4,400 | | |
| | Weight average molecular weight Mw | | | 60,000 | | 50,000 | | 60,000 | | 45,000 | | |
| | Acid value (mgKOH/g) | | | 13.2 | | 18.3 | | 15.9 | | 16.7 | | |
| | | | Production Example | | | | | | | | | |
| | | | A51 | | A52 | | A53 | | A54 | | A55 | |
| | | | Amorphous resin | | | | | | | | | |
| | | | A-51 | | A-52 | | A-53 | | A-54 | | A-55 | |
| | | | Charged amount (g) | Molar ratio *3 | Charged amount (g) | Molar ratio *3 | Charged amount (g) | Molar ratio *3 | Charged amount (g) | Molar ratio *3 | Charged amount (g) | Molar ratio *3 |
| Polyester resin monomers | Alcohol component | BPA-PO *1 | — | — | 5600 | 80 | — | — | — | — | — | — |
| | | BPA-EO *2 | 6500 | 100 | 1300 | 20 | 6500 | 100 | 6500 | 100 | 6500 | 100 |
| | Acid component | Terephthalic acid | 2656 | 80 | 1494 | 45 | 2490 | 75 | 996 | 30 | 1494 | 45 |
| | | Adipic acid | — | — | 1022 | 35 | 146 | 5 | 1460 | 50 | — | — |
| | | Sebacic acid | — | — | — | — | — | — | — | — | — | — |
| | | Succinic acid | — | — | — | — | — | — | — | — | 826 | 35 |
| | | Trimellitic anhydride | 461 | 12 | 461 | 12 | 461 | 12 | 461 | 12 | 461 | 12 |
| | | | Charged amount (g) | Parts by mass *4 | Charged amount (g) | Parts by mass *4 | Charged amount (g) | Parts by mass *4 | Charged amount (g) | Parts by mass *4 | Charged amount (g) | Parts by mass *4 |
| Catalyst | Tin(II) 2-ethylhexanoate | | 19.0 | 0.2 | 19.8 | 0.2 | 19.8 | 0.2 | 18.2 | 0.2 | 19.4 | 0.2 |
| Co-catalyst | Gallic acid monohydrate | | 1.9 | 0.02 | 2 | 0.02 | 2 | 0.02 | 1.8 | 0.02 | 1.9 | 0.02 |
| BPA-PO/BPA-EO molar ratio | | | 0/100 | | 80/20 | | 0/100 | | 0/100 | | 0/100 | |
| BPA-EO/aliphatic dicarboxylic acid molar ratio | | | — | | 0.57 | | 20.00 | | 2.00 | | 2.86 | |
| Properties | Softening point (° C.) | | 102.4 | | 100.3 | | 97.6 | | 99.3 | | 102.4 | |
| | Highest endothermic peak temperature (° C.) | | 64.2 | | 56.2 | | 57.6 | | 46.5 | | 52.1 | |
| | Crystallinity index | | 1.60 | | 1.78 | | 1.69 | | 2.14 | | 1.97 | |
| | Glass transition temperature (° C.) | | 62.0 | | 53.4 | | 55.3 | | 44.6 | | 49.6 | |
| | Number average molecular weight Mn | | 3,200 | | 3,000 | | 3,300 | | 5,000 | | 3,500 | |
| | Weight average molecular weight Mw | | 28,000 | | 22,000 | | 30,000 | | 70,000 | | 30,000 | |
| | Acid value (mgKOH/g) | | 19.5 | | 19.4 | | 20.2 | | 15.7 | | 18.4 | |

*1: Propylene oxide (2.2) adduct of bisphenol A

*2: Ethylene oxide (2.2) adduct of bisphenol A

*3: Molar ratio when the total alcohol components is 100 mol

*4: Amount based on 100 parts by mass of the total polyester resin monomers (parts by mass)

[Production of Resin Dispersions]

Examples X1 to X9 and Comparative Examples X1 to X5

(Production of Resin Dispersions X-1 to X-9 and X-51 to X-55)

A four-necked flask equipped with a nitrogen inlet tube, a reflux condenser, a stirrer, and a thermocouple was charged with a polyester resin and methyl ethyl ketone, and the contents were dissolved at 40° C.

Subsequently, triethylamine was added to control a degree of neutralization of 80 mol % relative to the acid value of the resin. After adding deionized water with stirring, 0.2 g of a defoaming agent emulsion "TEGO Foamex 825" (available from Evonik, active ingredient: 26% by mass) was added, the methyl ethyl ketone was distilled off under reduced pressure at 50° C., and 1.8 g of an antibacterial agent "Proxel GXL" (available from Lonza Inc.) was finally added, thereby obtaining resin dispersions X-1 to X-9 and X-51 to X-55. The volume median particle diameter $D_{50}$, the solid concentration, and the pH of the resin particle in each of the resulting resin dispersions are shown in Table 2.

TABLE 2

| | Resin dispersion X | | | | | | | | Various properties | | |
|---|---|---|---|---|---|---|---|---|---|---|---|
| | Resin dispersion No. | Polyester resin Kind | Charged amount (g) | MEK *1 (g) | Deionized water (g) | Triethylamine (g) | Defoaming agent * 2 | Antibacterial agent *3 | Volume median diameter $D_{50}$ (nm) | Solid concentration (% by mass) | pH |
| Example X1 | X-1 | A-1 | 300 | 300 | 720 | 7.0 | 0.2 | 1.8 | 95 | 31.2 | 7.4 |
| Example X2 | X-2 | A-2 | 300 | 300 | 720 | 7.9 | 0.2 | 1.8 | 101 | 28.7 | 7.5 |
| Example X3 | X-3 | A-3 | 300 | 300 | 720 | 7.4 | 0.2 | 1.8 | 104 | 30.1 | 7.1 |
| Example X4 | X-4 | A-4 | 300 | 300 | 720 | 8.0 | 0.2 | 1.8 | 89 | 29.5 | 7.5 |
| Example X5 | X-5 | A-5 | 300 | 300 | 720 | 9.3 | 0.2 | 1.8 | 93 | 28.6 | 7.4 |
| Example X6 | X-6 | A-6 | 300 | 300 | 720 | 5.7 | 0.2 | 1.8 | 97 | 30.5 | 7.6 |
| Example X7 | X-7 | A-7 | 300 | 300 | 720 | 7.0 | 0.2 | 1.8 | 104 | 30.8 | 7.4 |
| Example X8 | X-8 | A-8 | 300 | 300 | 720 | 7.0 | 0.2 | 1.8 | 105 | 31.2 | 7.5 |
| Example X9 | X-9 | A-9 | 300 | 300 | 720 | 7.0 | 0.2 | 1.8 | 102 | 32.1 | 7.4 |
| Comparative Example X1 | X-51 | A-51 | 300 | 300 | 720 | 8.4 | 0.2 | 1.8 | 100 | 30.1 | 7.4 |
| Comparative Example X2 | X-52 | A-52 | 300 | 300 | 720 | 8.4 | 0.2 | 1.8 | 105 | 31.0 | 7.6 |
| Comparative Example X3 | X-53 | A-53 | 300 | 300 | 720 | 7.0 | 0.2 | 1.8 | 140 | 29.9 | 7.4 |
| Comparative Example X4 | X-54 | A-54 | 300 | 300 | 720 | 7.0 | 0.2 | 1.8 | 92 | 29.5 | 7.8 |
| Comparative Example X5 | X-55 | A-55 | 300 | 300 | 720 | 8.0 | 0.2 | 1.8 | 93 | 32.2 | 7.8 |

*1: Charged amount of methyl ethyl ketone

* 2: Defoaming agent emulsion "TEGO Foamex 825" (available from Evonik, active ingredient: 26% by mass)

*3: Antibacterial agent "Proxel GXL" (available from Lonza Inc.)

Examples Y1 to Y10 and Comparative Examples Y1 to Y5

(Production of Coating Liquids Y-1 to Y-10 and Y-51 to Y-55 and Production of Thermal Transfer Image-Receiving Sheets)

Each of the resin dispersions and the additives therefor shown in Table 3 were mixed to obtain coating liquids Y-1 to Y-10 and Y-51 to Y-55.

On a cast coated paper (thickness: 210 μm), each of the obtained coating liquids was coated at 25° C. with a wire bar such that a coverage after drying was 5.0 g/m$^2$, and then dried at 60° C., thereby obtaining a thermal transfer image-receiving sheet having a receiving layer. The evaluation was performed by the following methods.

[Evaluation]

[Dyeability (Image Density)]

A black (K) gradation pattern was printed onto the prepared thermal transfer image-receiving sheet by using a commercially available sublimation-type thermal transfer printer "MEGAPIXEL III" (available from ALTECH ADS), and a density of transferred color obtained in a high-density printed image (18th gradation (L=0: maximum density)) was measured using a Gretag densitometer (available from GRETAG-MACBETH Corp.) for evaluating the dyeability. As the value is larger, the image density is higher, and the dyeability is more excellent.

[Releasability]

The releasability (heat fusion) was evaluated from a release sound generated when an ink ribbon was peeled from the thermal transfer image-receiving sheet upon printing a black solid image (entire surface printing at the 18th gradation) and a gradation pattern, according to the following criteria.

5: A noise different from the release sound is not generated upon printing the black solid image, and peeling can be achieved.

4: Though a noise different from the release sound is generated upon printing the black solid image, a noise different from the release sound is not generated upon printing the gradation pattern.

3: A noise different from the release sound is generated upon printing the gradation pattern.

2: A noise different from the release sound is generated upon printing the gradation pattern, and a loss (void) was observed in a part of the image.

1: Heat fusion occurs, and peeling is difficult, or peeling cannot be achieved.

[Storage Stability]

The resin dispersion was filled in a closed vessel and subjected to a storage test in a thermostat chamber at 70° C. After the elapse of 14 days, the resultant was taken out and measured for the volume average particle diameter ($D_V$). A change in particle diameter from the initial stage was observed, and a rate of change in average particle diameter was calculated according to the following formula (round down to the nearest decimal). The storage stability was evaluated according to the following evaluation criteria.

Rate of change in average particle diameter (%)={(Volume average particle diameter ($D_V$) after storage−Volume average particle diameter ($D_V$) before storage)/Volume average particle diameter ($D_V$) before storage}×100

A: Absolute value of the rate of change in average particle diameter after being stored at 70° C. for 14 days was less than 5%.

B: Absolute value of the rate of change in average particle diameter after being stored at 70° C. for 14 days was 5% or more and less than 15%.

C: Absolute value of the rate of change in average particle diameter after being stored at 70° C. for 14 days was 15% or more and less than 30%.

D: Absolute value of the rate of change in average particle diameter after being stored at 70° C. for 14 days was 30% or more, or the coating liquid had no flowability, and the measurement of an average particle diameter was impossible.

TABLE 3

| | Coating liquid Y | | | | | | | | | | |
|---|---|---|---|---|---|---|---|---|---|---|---|
| | | | | Film-forming agent *1 | | Releasing agent | | | | | |
| | | Resin dispersion X | | | Ratio *3 | | | Ratio *3 | Evaluation | | |
| | Kind | Kind | Charged amount (g) | Charged amount (g) | (parts by mass) | Charged amount (g) | Kind *2 | (parts by mass) | Dyeability | Releasability | Storage stability |
| Example Y1 | Y-1 | X-1 | 2.5 | 0.08 | 11 | 0.04 | L-7230 | 5 | 1.93 | 5 | A |
| Example Y2 | Y-2 | X-2 | 2.5 | 0.08 | 11 | 0.04 | L-7230 | 5 | 1.83 | 3 | B |
| Example Y3 | Y-3 | X-3 | 2.5 | 0.08 | 11 | 0.04 | L-7230 | 5 | 1.75 | 5 | B |
| Example Y4 | Y-4 | X-4 | 2.5 | 0.08 | 11 | 0.04 | L-7230 | 5 | 1.86 | 4 | B |
| Example Y5 | Y-5 | X-5 | 2.5 | 0.08 | 11 | 0.04 | L-7230 | 5 | 1.91 | 3 | B |
| Example Y6 | Y-6 | X-6 | 2.5 | 0.08 | 11 | 0.04 | L-7230 | 5 | 1.87 | 5 | A |
| Example Y7 | Y-7 | X-7 | 2.5 | 0.08 | 11 | 0.04 | L-7230 | 5 | 1.79 | 4 | B |
| Example Y8 | Y-8 | X-8 | 2.5 | 0.08 | 11 | 0.04 | L-7230 | 5 | 1.76 | 4 | B |
| Example Y9 | Y-9 | X-9 | 2.5 | 0.08 | 11 | 0.04 | L-7230 | 5 | 1.95 | 5 | A |
| Example Y10 | Y-10 | X-1 | 2.5 | 0.08 | 11 | 0.04 | KF-615A | 5 | 1.92 | 3 | A |
| Comparative Example Y1 | Y-51 | X-51 | 2.5 | 0.08 | 11 | 0.04 | L-7230 | 5 | 1.72 | 1 | D |
| Comparative Example Y2 | Y-52 | X-52 | 2.5 | 0.08 | 11 | 0.04 | L-7230 | 5 | 1.74 | 3 | D |
| Comparative Example Y3 | Y-53 | X-53 | 2.5 | 0.08 | 11 | 0.04 | L-7230 | 5 | 1.74 | 2 | D |
| Comparative Example Y4 | Y-54 | X-54 | 2.5 | 0.08 | 11 | 0.04 | L-7230 | 5 | 1.74 | 2 | C |
| Comparative Example Y5 | Y-55 | X-55 | 2.5 | 0.08 | 11 | 0.04 | L-7230 | 5 | 1.80 | 2 | D |

*1: Butyl carbitol acetate

*2: L-7230: Polyether-modified silicone "Silwet ® L-7230" (available from Momentive Performance Materials Inc. (HLB: 6.3, kinematic viscosity: 4,000 $mm^2/s$, polyether-modified silicone having a polyethylene oxide/propylene oxide chain grafted on a polydialkylsiloxane main chain))
KF-615A: Polyether-modified silicone "KF-615A" (available from Shin-Etsu Chemical Co., Ltd.,
HLB: 10. kinematic viscosity 920 $mm^2/s$)

*3: Amount based on 100 parts by mass of the polyester resin (parts by mass)

From the comparison between the Examples and the Comparative Examples, it is noted that in accordance with the dispersion according to the embodiment of the present invention, the releasability and the storage stability are excellent while maintaining the dyeability.

The invention claimed is:

1. A resin dispersion for a dye receiving layer of a thermal transfer image-receiving sheet, comprising a polyester resin particle and an aqueous medium, wherein the polyester resin particle comprises a polyester resin that is a polycondensate of an alcohol component comprising at least one selected from the group consisting of a propylene oxide adduct of 2,2-bis(4-hydroxyphenyl)propane and an ethylene oxide adduct of 2,2-bis(4-hydroxyphenyl)propane and a carboxylic acid component comprising adipic acid, terephthalic acid, and trimellitic acid anhydride, a molar ratio of the propylene oxide adduct of 2,2-bis(4-hydroxyphenyl)propane to the ethylene oxide adduct of 2,2-bis(4-hydroxyphenyl)propane in the alcohol component is from 0/100 to 40/60, and a molar ratio of the ethylene oxide adduct of 2,2-bis(4-hydroxyphenyl)propane to the adipic acid is from 2.1 to 15.

2. The resin dispersion according to claim 1, wherein a glass transition temperature of the polyester resin is 30° C. to lower than 60° C.

3. The resin dispersion according to claim 1, wherein a softening point of the polyester resin is 80° C. to 120° C.

4. The resin dispersion according to claim 1, wherein the carboxylic acid component of the polyester resin comprises from 7 mol % to 50 mol % of the adipic acid.

5. The resin dispersion according to claim 1, wherein a volume median particle diameter (D50) of the polyester resin particle is 1 μm or less.

6. The resin dispersion according to claim 1, wherein a solid concentration of the resin dispersion is from 20% by mass to 50% by mass.

7. The resin dispersion according to claim 1, wherein the molar ratio of the propylene oxide adduct of 2,2-bis(4-hydroxyphenyl)propane to the ethylene oxide adduct of 2,2-bis(4-hydroxyphenyl)propane in the alcohol component is from 0/100 to 30/70.

8. The resin dispersion according to claim 1, wherein the molar ratio of the propylene oxide adduct of 2,2-bis(4-hydroxyphenyl)propane to the ethylene oxide adduct of 2,2-bis(4-hydroxyphenyl)propane in the alcohol component is from 0/100 to 20/80.

9. The resin dispersion according to claim 1, wherein the molar ratio of the propylene oxide adduct of 2,2-bis(4-hydroxyphenyl)propane to the ethylene oxide adduct of 2,2-bis(4-hydroxyphenyl)propane in the alcohol component is from 0/100 to 10/90.

10. A coating liquid for forming a receiving layer of a thermal transfer linage-receiving sheet, comprising the resin dispersion according to claim 1.

11. The coating liquid according to claim 10, further comprising a film-forming agent.

12. The coating liquid according to claim 10, further comprising a releasing agent.

13. The coating liquid according to claim 12, wherein an HLB of the releasing agent is 3 or more and 9 or less.

14. The coating liquid according to claim 12, wherein a kinematic viscosity of the releasing agent is 1,500 $mm^2/s$ or more and 8,000 $mm^2/s$ or less.

15. A thermal transfer image-receiving sheet comprising a substrate and a receiving layer formed with the coating liquid according to claim 10.

16. A printing method comprising:

bringing a heat-sensitive transfer recording medium containing a dye into contact with the thermal transfer image-receiving sheet according to claim 15;

thermally-transferring the dye onto the thermal transfer image-receiving sheet.

17. A method for producing a thermal transfer image-receiving sheet, the method comprising:

forming a receiving layer on a substrate by using a coating liquid comprising a resin dispersion comprising a polyester resin particle and an aqueous medium, wherein the polyester resin particle comprises a polyester resin that is a polycondensate of an alcohol component comprising at least one selected from the group consisting of a propylene oxide adduct of 2,2-bis(4-hydroxyphenyl)propane and an ethylene oxide adduct of 2,2-bis(4-hydroxyphenyl)propane and a carboxylic acid component comprising adipic acid, terephthalic acid, and trimellitic acid anhydride, a molar ratio of the propylene oxide adduct of 2,2-bis(4-hydroxyphenyl)propane to the ethylene oxide adduct of 2,2-bis(4-hydroxyphenyl)propane in the alcohol component is from 0/100 to 40/60, and a molar ratio of the ethylene oxide adduct of 2,2-bis(4-hydroxyphenyl)propane to the aliphatic dicarboxylic acid compound having a carbon number of from 6 to 10 is from 2.1 to 15.

* * * * *